US005926114A

United States Patent [19]

Andrews

[11] Patent Number: 5,926,114

[45] Date of Patent: Jul. 20, 1999

[54] INTERSECTION WARNING SYSTEM

[75] Inventor: Scott Andrews, Seto, Japan

[73] Assignee: Toyota Jidosha Kabushiki Kaisha, Japan

[21] Appl. No.: 09/098,542

[22] Filed: Jun. 17, 1998

[30] Foreign Application Priority Data

May 18, 1998 [JP] Japan ..... 10-135432

[51] Int. Cl.[6] ..... G08G 1/07; G08G 1/16

[52] U.S. Cl. ..... 340/909; 340/901; 340/902; 340/903; 340/904; 340/905; 340/435; 180/167; 701/117; 701/301

[58] Field of Search ..... 340/901–906, 340/909, 910, 435, 436; 180/167, 169; 701/117, 118, 301

[56] References Cited

U.S. PATENT DOCUMENTS

| | | | |
|---|---|---|---|
| 5,083,125 | 1/1992 | Brown et al. | 340/906 |
| 5,214,793 | 5/1993 | Conway et al. | 340/905 |
| 5,497,148 | 3/1996 | Oliva | 340/905 |
| 5,572,202 | 11/1996 | Regel et al. | 340/917 |

FOREIGN PATENT DOCUMENTS 4-286100 10/1992 Japan .

7-14099 1/1995 Japan .

*Primary Examiner*—Donnie L. Crosland

*Attorney, Agent, or Firm*—Finnegan, Henderson, Farabow, Garrett & Dunner, L.L.P.

[57] ABSTRACT

An intersection warning system includes a vehicle-side system provided in a vehicle, and a road-side system. The vehicle-side system includes a transmitting unit emitting a radar signal to a forward area of the vehicle, a receiving unit receiving a signal from the forward area of the vehicle, a reflected signal detecting unit determining whether the signal received by the receiving unit is a reflected signal of the radar signal emitted by the transmitting unit, and warning means for issuing a warning when the reflected signal detecting unit determines that the received signal is the reflected signal of the radar signal. The road-side system includes a signal return unit, provided for each of lanes intersecting each other at an intersection, receiving the radar signal from the vehicle approaching the intersection on each of the lanes and returning a virtual reflected signal toward the vehicle, a vehicle watching unit watching the lanes intersecting each other at the intersection and detecting a vehicle approaching the intersection, and a control means for activating the signal returning unit provided for at least one of the lanes when the vehicle watching unit detects vehicles approaching the intersection on the lanes intersecting each other.

8 Claims, 9 Drawing Sheets

INTERSECTION WARNING SYSTEM

BACKGROUND OF THE INVENTION

1. Field of the Invention

The present invention generally relates to an intersection warning system, and more particularly to an intersection warning system by which a driver of a vehicle approaching an intersection is warned when another vehicle is approaching the intersection from a side direction.

2. Description of the Related Art

In the related art, an intersection warning system as disclosed in Japanese Laid Open Patent Application No.7-14099 has been proposed. In this system, when a vehicle is approaching the intersection from one direction, another vehicle approaching the intersection from another direction (from the side) is detected by a laser radar and detecting information is transmitted to the vehicle approaching the intersection from the one direction. In the vehicle which receives the detecting information, warning is issued so that a driver of the vehicle is informed of the presence of the other vehicle approaching the intersection from the side.

Meanwhile, in recent years, vehicles have been made more intelligent. To intellectualize the vehicles, for example, an obstacle detecting system and an active cruise control system (ACC system) have been proposed. In such systems, the forward area of a vehicle is watched, for example, by using radar. That is, a transmitter emits radio waves or laser beams and it is checked whether reflected waves are received by a receiver. The distance between the vehicle and an obstacle in the forward area of the vehicle is then measured based on the period between a time at which the radio waves were emitted and a time at which the reflected waves are detected.

Particularly, in the obstacle detecting system, when an obstacle is detected based on the result of watching the forward area of the vehicle, a warning is issued and/or a braking control is performed so that the vehicle stops before the obstacle. In the active cruise control system, when a forward vehicle is detected based on the result of watching the forward area of the vehicle, accelerating control and braking control are performed so that the distance between the vehicle and the forward vehicle is maintained at a constant value.

In a case where a vehicle is intellectualized, since a plurality of systems is to be provided in the vehicle, it is preferable that similar functioning units be shared by the plurality of systems.

However, in a case where a vehicle-side system (having a receiver and other units) of the conventional intersection warning system as described above is provided in a vehicle having the obstacle detecting system and/or the adaptive cruise control system, objects to be detected differ from each other between the systems. Thus, although the radio waves have to be received in each of the respective systems of the vehicle, the receiver can not be shared by the respective systems.

SUMMARY OF THE INVENTION

Accordingly, a general object of the present invention is to provide a novel and useful intersection warning system in which the aforementioned disadvantages of the prior art are eliminated.

And a specific object of the present invention is to provide an intersection warning system by which a transmitting-and-receiving system of a system watching the forward area of a vehicle can be shared.

The above objects of the present invention are achieved by an intersection warning system comprising: a vehicle-side system provided in a vehicle; and a road-side system, wherein the vehicle-side system comprises: a transmitting unit emitting a radar signal to a forward area of the vehicle; a receiving unit receiving a signal from the forward area of the vehicle; a reflected signal detecting unit determining whether the signal received by the receiving unit is a reflected signal of the radar signal emitted by the transmitting unit; and warning means for issuing a warning when the reflected signal detecting unit determines that the received signal is the reflected signal of the radar signal, and wherein the road-side system comprises: a signal return unit, provided for each of lanes intersecting each other at an intersection, receiving the radar signal from the vehicle approaching the intersection on each of the lanes and returning a virtual reflected signal toward the vehicle; a vehicle watching unit watching the lanes intersecting each other at the intersection and detecting a vehicle approaching the intersection; and control means for activating the signal returning unit provided for at least one of the lanes when the vehicle watching unit detects vehicles approaching the intersection on the lanes intersecting each other.

In the intersection warning system according to the present invention, when the vehicle is approaching the intersection and another vehicle is approaching the intersection from the side, the virtual reflected signal is returned to the vehicle from the signal return unit which receives the radar signal from the vehicle. When the reflected signal detecting unit of the vehicle-side system determines that the received signal is the (virtual) reflected signal, the warning means issues the warning. Based on the warning, the driver of the vehicle can recognize that there is another vehicle approaching the intersection from the side.

When there is a body in the forward area of the vehicle, the radar signal emitted from the vehicle-side system is reflected by the body. When the reflected signal from the body is received by the vehicle-side system, it can be recognized, based on receiving the reflected signal, that there is a body in the forward area of the vehicle. Thus, the intersection warning system can share the transmitting-and-receiving system with the system watching the forward area of the vehicle.

In the intersection warning system, the style of warning is not limited. For example, a sound, a display and a vibration may be used as the warning.

The above control means may comprise running state detecting means for detecting a running state of each of vehicles approaching the intersection; and warning determination means for determining, based on the running state of each of the vehicles, whether a warning should be issued, wherein when the warning determination means determines that the warning should be issued, the signal return unit is activated.

The above running state is a state including at least a speed, an acceleration (a deceleration) and a relative position of the vehicle with regard to the intersection (the distance between the vehicle and the intersection).

The above signal return unit may generate the reflected signal in response to receiving the radar signal from the vehicle. However, in view of simplicity of the constitution of the signal return unit, the above signal return unit may comprise receiving means for receiving the radar signal from the vehicle; transmitting means for returning the radar signal received by the receiving means as a virtual reflected signal toward the vehicle when being connected to the receiving means; and switching means for switching connection and disconnection between the receiving means and the transmitting means, wherein the control means controls the switching means so that the receiving means and transmitting means are connected and disconnected.

In this case, the radar signal received by the receiving means is returned to the vehicle as a virtual reflected signal.

The transmitting unit, the receiving unit and the reflected signal detecting unit all of which are in the vehicle-side system may be shared with the watching system watching the forward area of the vehicle. In this case, to be capable of easily determining whether the received reflected signal has been obtained by the present intersection warning system, in the intersection warning system of the present invention, the road-side system may further comprise: information merger means for merging the virtual reflected signal from the signal return unit with predetermined information, the vehicle-side system may further comprise: merger information determination means for determining whether the predetermined information is included in the signal received by the receiving unit, and when the merger information determination means determines that the predetermined information is included in the received signal, the warning means issues the warning.

To provide an intersection warning system by which the warning is issued to the driver of the vehicle approaching the intersection regardless of states of other vehicles approaching the intersection from the side, the present invention may be an intersection warning system comprising: a vehicle-side system provided in a vehicle; and a road-side system, wherein the vehicle-side system comprises: a transmitting unit emitting a radar signal to a forward area of the vehicle; a receiving unit receiving a signal from the forward area of the vehicle; a reflected signal detecting unit determining whether the signal received by the receiving unit is a reflected signal of the radar signal emitted by the transmitting unit; and warning means for issuing a warning when the reflected signal detecting unit determines that the received signal is the reflected signal of the radar signal, and wherein the road-side system comprises: a signal return unit, provided for each of lanes intersecting each other in an intersection, receiving the radar signal from the vehicle approaching the intersection on each of the lanes and returning a virtual reflected signal toward the vehicle; a vehicle watching unit watching the lanes intersecting each other at the intersection and detecting a running state a vehicle approaching the intersection on each of the lanes; signal state detecting means for detecting a state of a traffic-signal provided for each of the lanes at the intersection, the traffic-signal indicating at least a first state for permitting vehicles to pass through the intersection and a second state for prohibiting vehicles from passing through the intersection; warning determination means for determining, based on the running state of the vehicle detected by the vehicle watching means and the state of the traffic-signal detected by the signal state detecting means, whether a warning should be issued; and control means for activating the signal return unit when the warning determination means determines that the warning should be issued.

The vehicle-side intersection warning system may comprise: a transmitting unit emitting a radar signal to a forward area of the vehicle; a receiving unit receiving a signal from the forward area of the vehicle; a reflected signal detecting means determining whether the signal received by the receiving unit is a reflected signal of the radar signal emitted by the transmitting unit; a merger information determination unit determining whether the received signal includes predetermined information; and warning means for issuing a warning when the reflected signal detecting means determines that the received signal is the reflected signal of the radar signal and the merger information determination unit determines that the received signal includes the predetermined information.

BRIEF DESCRIPTION OF THE DRAWINGS

Other objects, features and advantages of the present invention will be apparent from the following description when read in conjunction with the accompanying drawings, in which.

DESCRIPTION OF THE PREFERRED EMBODIMENTS

A description will be given of an intersection warning system according to an embodiment of the present invention.

Figure 1:
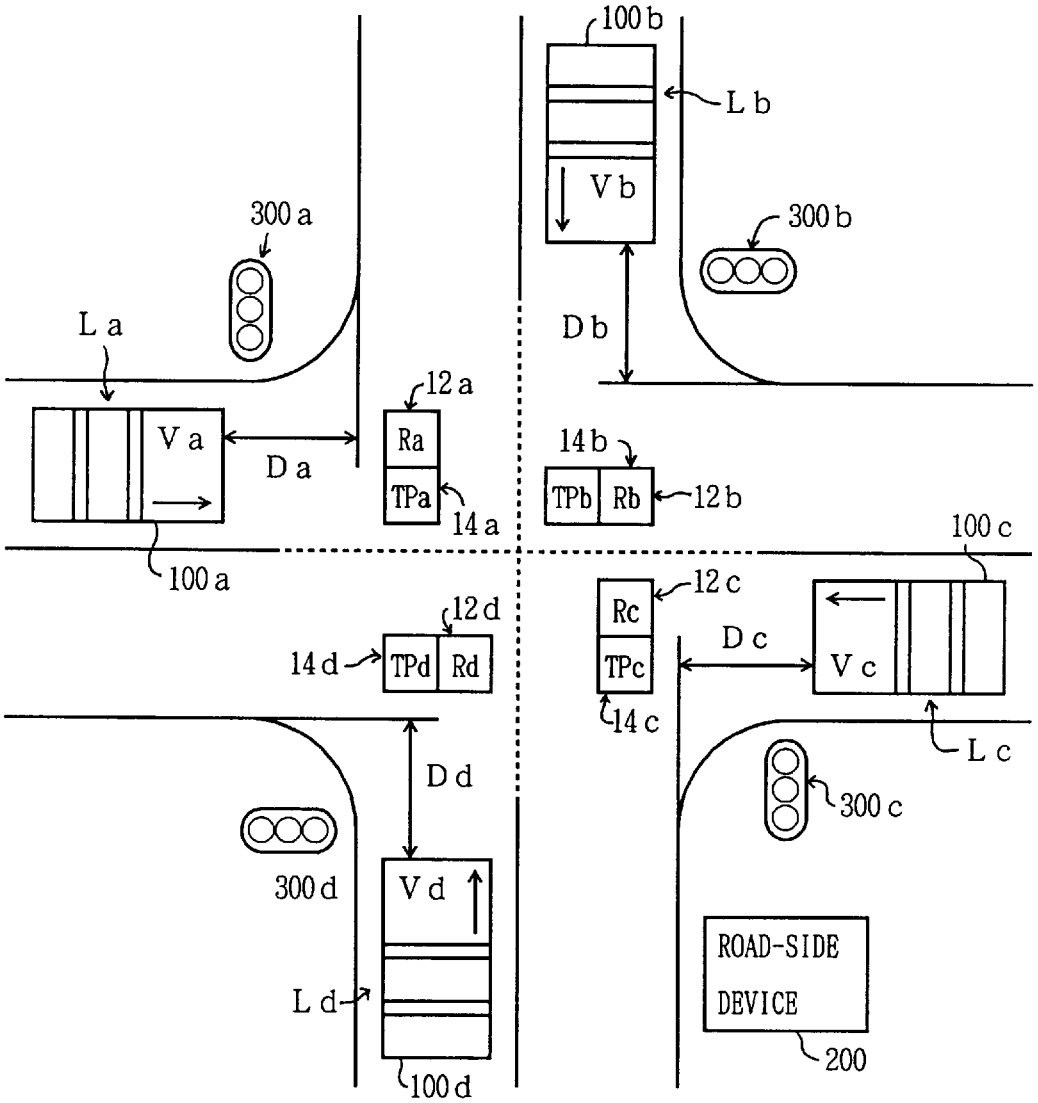
FIG. 1 is a drawing illustrating states of an intersection to which an intersection warning system according to an embodiment of the present invention is applied.

A state of an intersection to which an intersection warning system according to an embodiment of the present invention is applied is shown in FIG. 1.

Referring to FIG. 1, a road having lanes La and Lc on which vehicles are running in opposite directions and a road having lanes Lb and Ld on which vehicles are running in opposite directions cross each other at an intersection. Thus, the lane La crosses the respective lanes Lb and Ld, the lane Lb crosses the respective lanes Lc and La, the lane Lc crosses the respective lanes Ld and Lb and the lane Ld crosses the respective lanes La and Lc. At a corner of the intersection at which the lanes La and Ld are crossed, a traffic-signal 300*a* is installed. At a corner of the intersection at which the lanes Lb and La are crossed, a traffic-signal 300*b* is installed. At a corner of the intersection at which the lanes Lc and Lb are crossed, a traffic-signal 300*c* is installed. At a corner of the intersection at which the lanes Ld and Lc are crossed, a traffic-signal 300*d* is installed.

In addition, in the intersection, radar units 12*a*–12*d* and transponders 14*a*–14*d* are installed. The radar unit 12*a* and the transponder 14*a* face a vehicle 100*a* approaching the intersection on the lane La. The radar unit 12*b* and the transponder 14*b* face a vehicle 100*b* approaching the intersection on the lane Lb. The radar unit 12*c* and the transponder 14*c* face a vehicle 10*c* approaching the intersection on the lane Lc. The radar unit 12*d* and the transponder 14*d* face a vehicle 100*d* approaching the intersection on the lane Ld.

Further, at the road side of the intersection, a road-side device 200 is installed. The road-side device 200 is mounted with a controller and a traffic-signal controller. The controller controls the respective radar units 12*a*–12*d* and the transponders 14*a*–14*d*. The traffic-signal controller controls the traffic signals 300*a*–300*d* installed at the road sides of the intersection.

Figure 2:
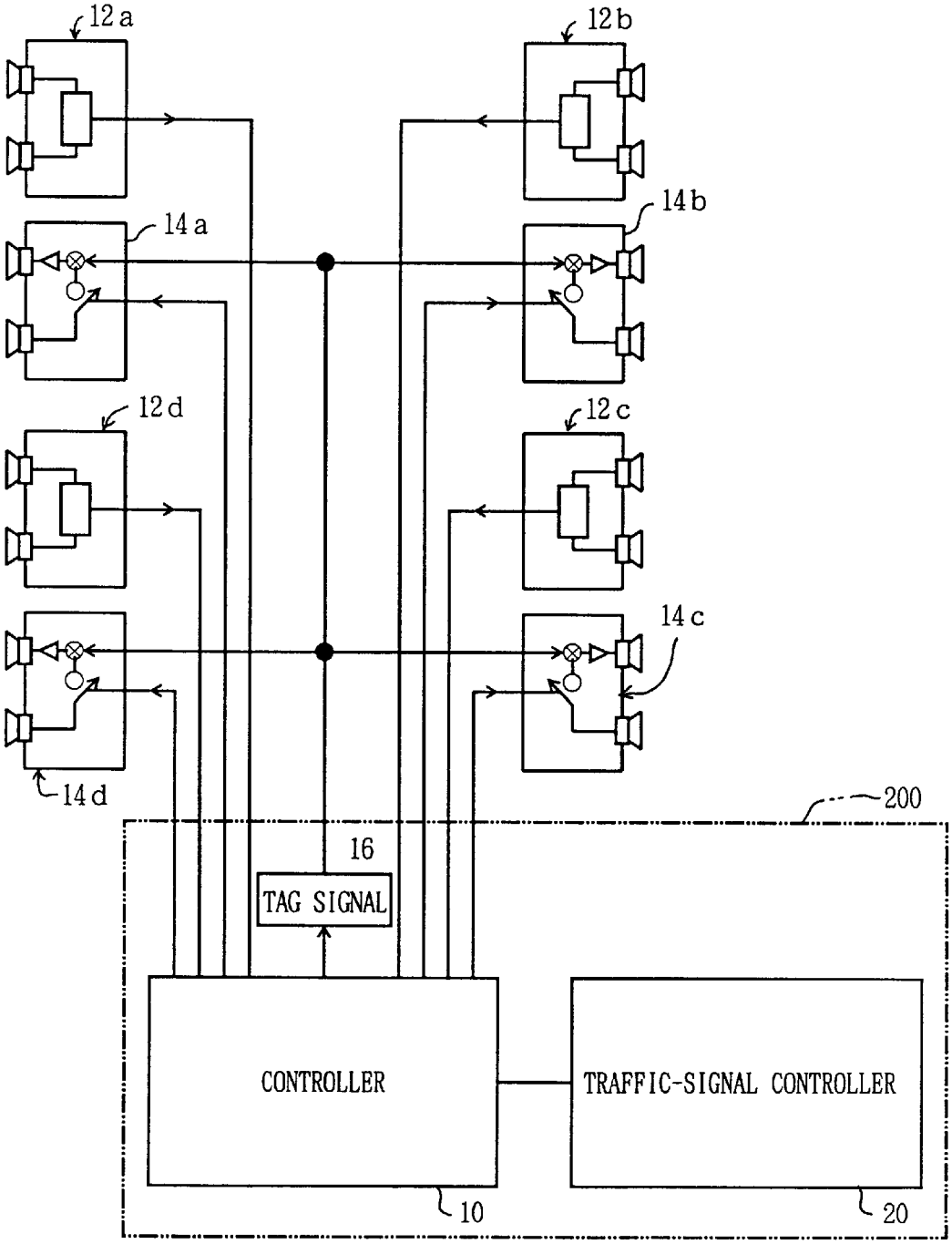
FIG. 2 is a drawing illustrating a constitution of a system installed at the road side.

The respective radar units 12*a*–12*d*, the respective transponders 14*a*–14*d* and the controllers mounted in the road-side device 200 are coupled as shown in FIG. 2.

Referring to FIG. 2, the road-side device 200 is mounted with the controller 10, the traffic-signal controller 20 and a tag signal merger circuit 16. The respective radar units 12*a*–12*d* and the respective transponders 14*a*–14*d* are connected to the controller 10. The controller 10 controls the transponders 14*a*–14*d* based on measurement data from the respective radar units 12*a*–12*d*. The controller 10 further controls the transponders 14*a*–14*d* based on signal states of the traffic-signals 300*a*–300*d* which are obtained from the traffic-signal controller 20.

The tag signal merger circuit 16 controlled by the controller 10 outputs a tag signal having a predetermined format. The tag signal is supplied from the tag signal merger circuit 16 to each of the transponders 14*a*–14*d*.

Figure 3:
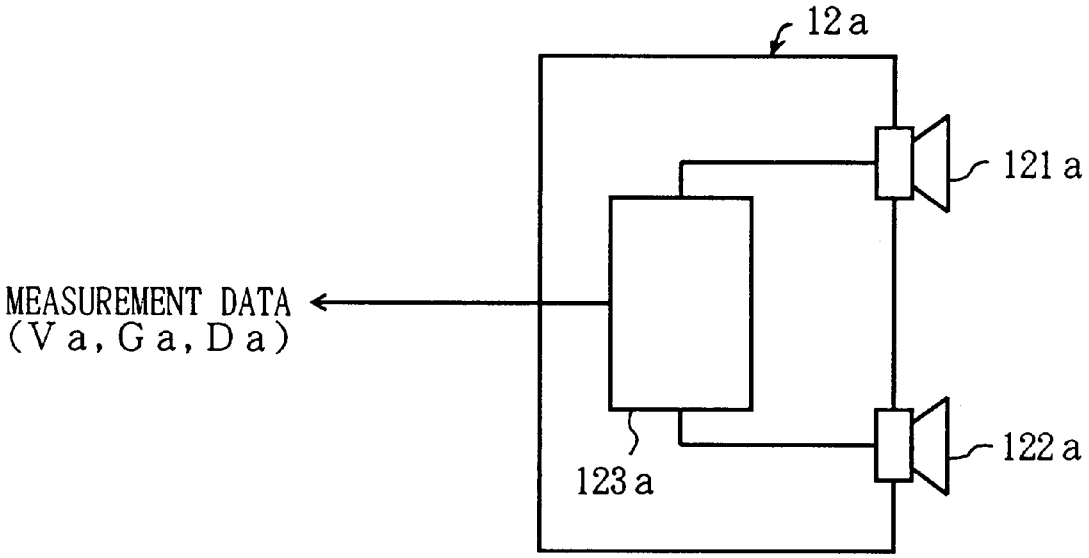
FIG. 3 is a diagram illustrating a constitution of each of radar units installed in the intersection.

Each of the radar units 12*a*–12*d* is formed as shown in FIG. 3. Although FIG. 3 shows a constitution of a the radar unit 12*a*, the other radar units 12*b*–12*d* have the same constitution as the radar unit 12*a*.

Referring to FIG. 3, the radar unit 12*a* has a radar transmitter 121*a*, a radar receiver 122*a* and a signal processing unit 123*a*. The radar transmitter 121*a* transmits a radar signal (e.g., laser beams or extremely high frequency waves). The radar receiver 122*a* receives a reflected signal obtained by reflection, on a body, of the radar signal transmitted by the radar transmitter 121*a*. Based on the difference between a time at which the radar signal was transmitted by the radar transmitter 121*a* and a time at which the reflected signal is received by the radar receiver 122*a*, the signal processing unit 123*a* calculates a speed Va and an acceleration rate (including a deceleration rate) Ga, of the vehicle 100*a* approaching the intersection on the Lane La on which the radar unit 12*a* is installed, and the distance between the vehicle 100*a* and the intersection (see FIG. 1). The calculated speed Va, acceleration rate Ga and the distance Da are supplied from the signal processing unit 123*a* to the controller 10 as the measurement data.

Figure 4:
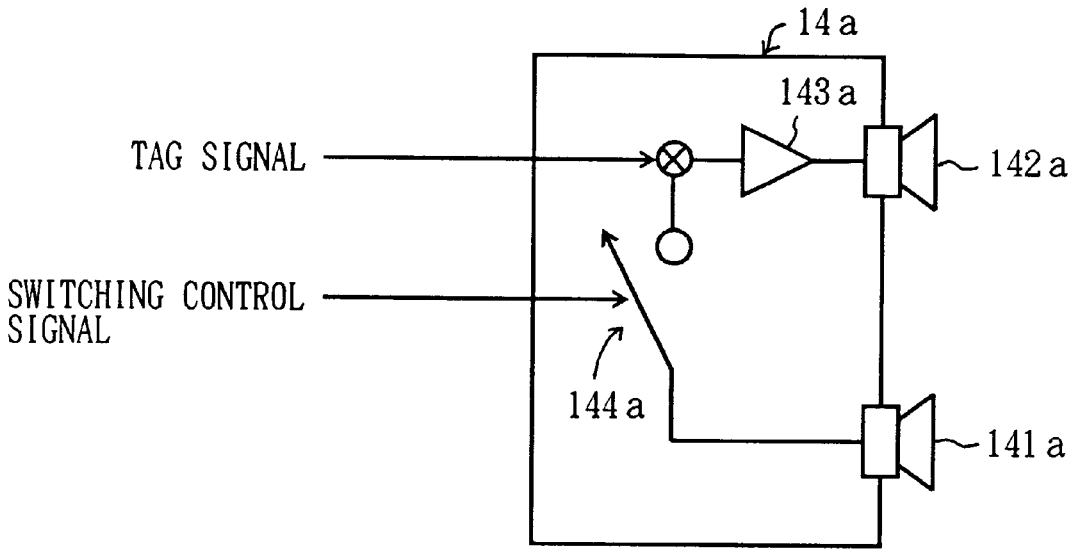
FIG. 4 is a diagram illustrating a constitution of each of transponders installed in the intersection.

Each of the transponders 14*a*–14*d* is formed as shown in FIG. 4. Although FIG. 4 shows the constitution of the transponder 14*a*, the other transponders 14*b*–14*d* have the same constitution as the transponder 14*a*.

Referring to FIG. 4, the transponder 14*a* has a receiver 141*a*, a transmitter 142*a*, an amplifier 143*a* and a switching unit 144*a*. The receiver 141*a* receives a radar signal. The receiver 141*a* is connected with the transmitter 142*a* through the switching unit 144*a* and the amplifier 143*a*. The switching unit 144*a* is turned on and off based on a switching control signal supplied from the controller 10. When the switching unit 144*a* is in an on-state, the signal received by the receiver 141*a* is supplied to the transmitter 142 through the switching unit 144*a* and the amplifier 143*a*. The tag signal from the tag signal merger circuit 16 described above is input to the amplifier 143*a*, so that the received signal from the receiver 141*a* is merged with the tag signal. The transmitter 142*a* transmits a signal into which the received signal from the receiver 141*a* and the tag signal are merged.

Figure 5:
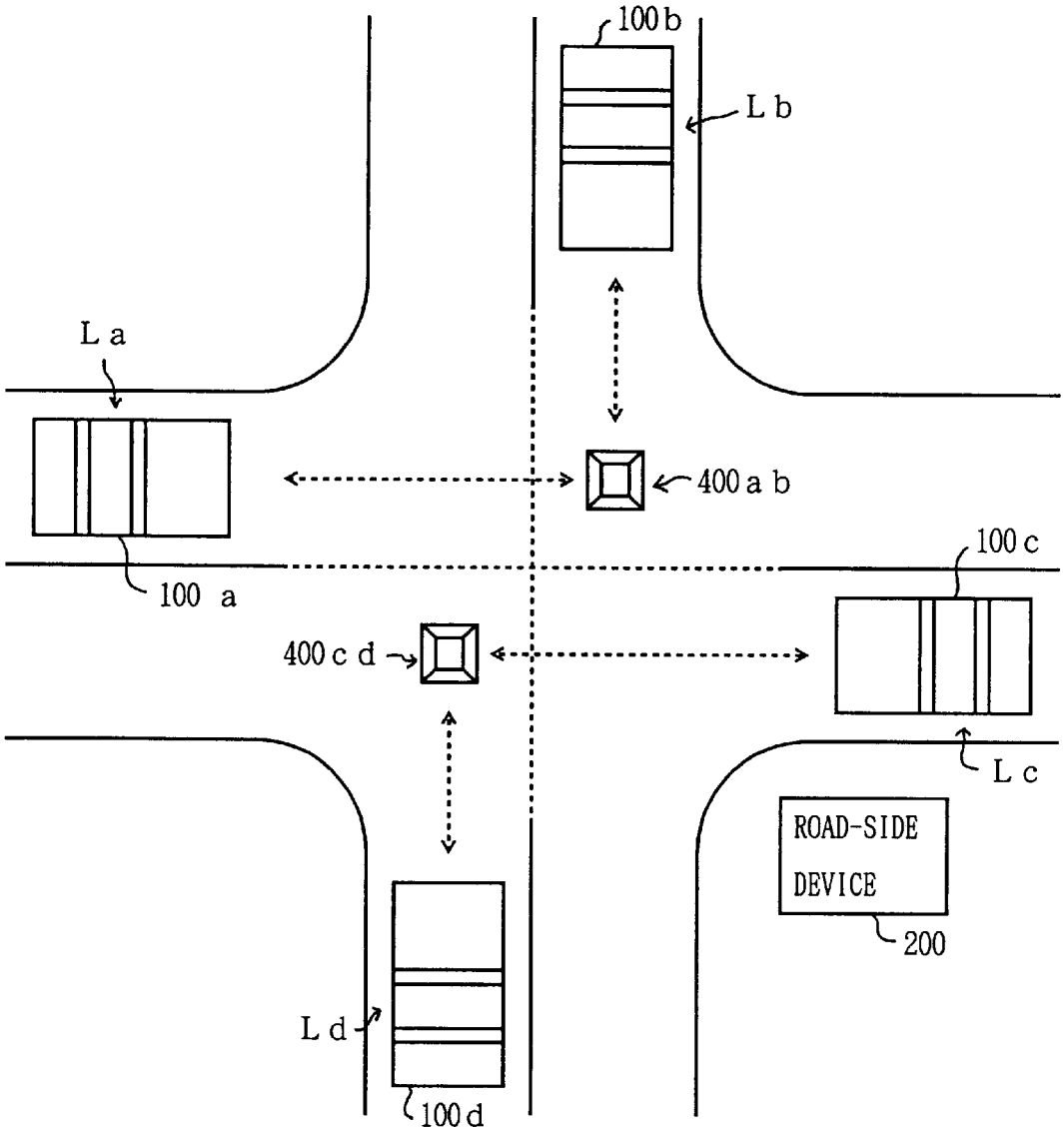
FIG. 5 is a diagram illustrating an example of installation of the radar units and the transponders in the intersection.
Figure 6:
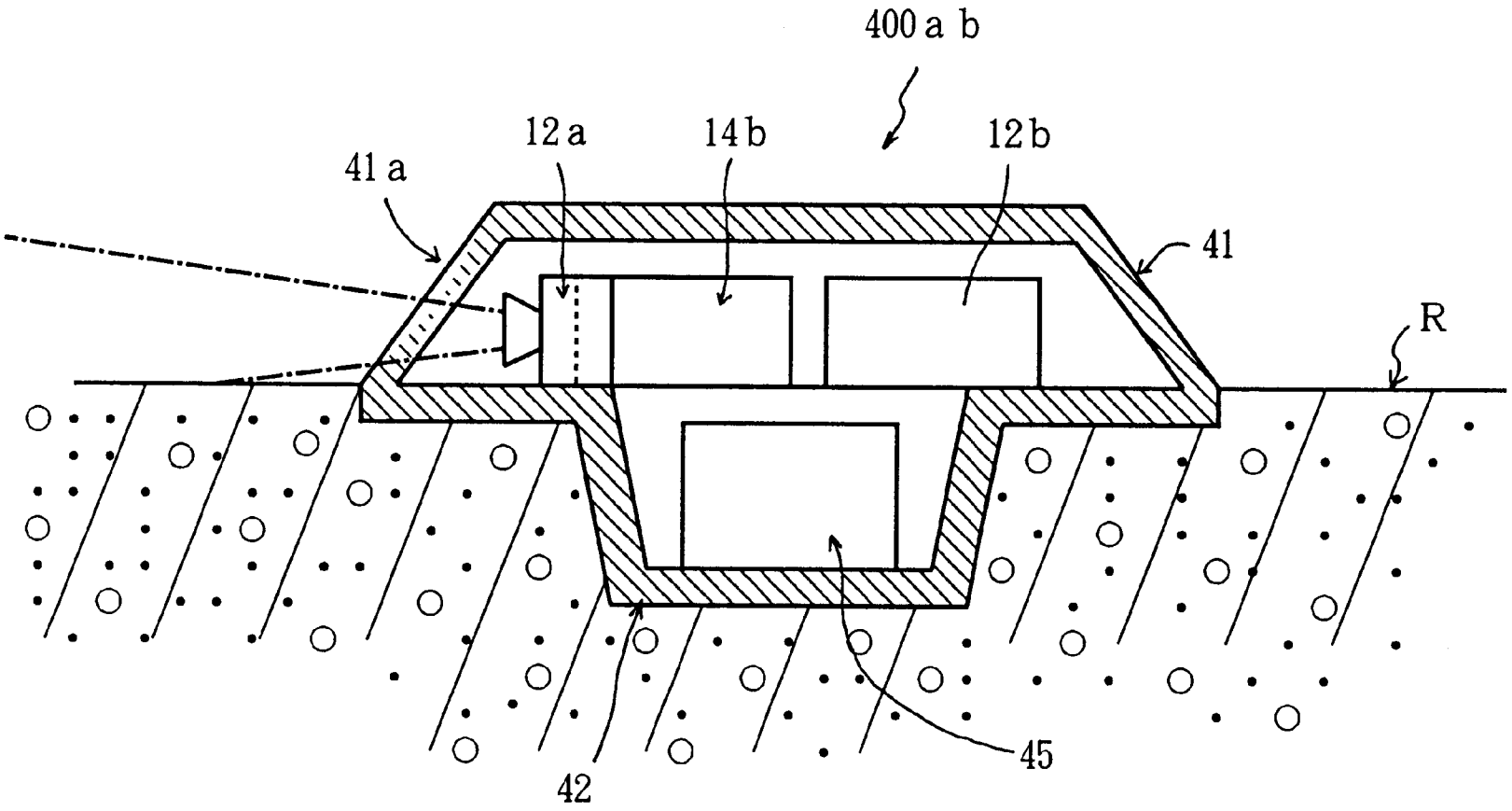
FIG. 6 is a cross sectional view showing a constitution of a mounting block installed in the intersection.

The respective radar units 12*a*–12*d* and the respective transponders 14*a*–14*d* are installed in the intersection as shown in FIGS. 5 and 6.

Referring to FIG. 5, on an intersection area at which the lanes La and Lb intersect, a mounting block 400*ab* is installed. The mounting block 400*ab* is mounted with the radar units 12*a* and 12*b* and the transponders 14*a* and 14*b* which are to be used for the vehicles 100*a* and 100*b* on the lanes La and Lb. On an intersection area at which the lanes Lc and Ld intersect, a mounting block 400*cd* is installed. The mounting block 400*cd* is mounted with the radar units 12*c* and 12*d* and the transponders 14*c* and 14*d* which are to be used for the vehicles 100*c* and 100*d* on the lanes Lc and Ld.

Each of the mounting blocks 400*ab* and 400*cd* is formed and installed on the road as shown in FIG. 6. Although FIG. 6 shows the constitution and installation of the mounting block 400*ab*, the mounting block 400*cd* is formed and installed on the road in the same manner as the mounting block 400*ab*.

Referring to FIG. 6, the mounting block 400*ab* has a structure into which a projecting block portion 41 and an underground block potion 42 are integrated. The projecting block portion 41 is projected from the surface of the road R. The underground block portion 42 is buried under the surface of the road R. The mounting block 400*ab* is made of metal such as aluminum or strong plastic. The projecting block portion 41 has a structure in which side surfaces are inclined and the cross section thereof is a trapezoid so that vehicles are not prevented from running in the intersection. A side surface of the projecting block portion 41 facing the vehicle 100*a* approaching the intersection on the lane La has a window 41*a* which is transparent (formed, for example, of reinforced plastic). A side surface of the projection block portion 41 facing the vehicle 100*b* approaching the intersection on the lane Lb has a window having the same structure as in the above case (not shown).

The projecting block portion 41 is mounted with the radar transmitter 121*a* and the radar receiver 122*a* of the radar unit 12*a* (see FIG. 3) and the receiver 141*a* and the transmitter 142*a* of the transponder 14*a* (not shown in FIG. 5) all of which face the window 41*a*. As a result of this structure, the radar signal from the radar transmitter 121*a* can be transmitted through the window 41*a* toward the vehicle 100*a* approaching the intersection on the lane La. The reflected signal, of the radar signal, from the vehicle 100*a* can be received through the window 41*a* by the radar receiver 122*a*. In addition, the receiver 141*a* of the transponder 14*a* can receive signals through the window 41*a* and a return signal based on the received signal can be transmitted from the transmitter 142*a* through the window 41*a* toward the vehicle 100*a* approaching the intersection on the lane La.

Further, the projecting block portion 41 is mounted with the radar transmitter and the radar receiver of the radar unit 12*b* and the receiver and the transmitter of the transponder 14*b* all of which face the other window. As the result of the structure, in the same manner as in the above case, the radar signal from the radar transmitter can be transmitted through the window toward the vehicle 100*b* approaching the intersection on the lane Lb. In addition, the reflected signal, of the radar signal, from the vehicle 100*b* can be received through the window by the radar receiver. The receiver of the transponder 14*b* can receive signals through the window and a return signal based on the received signal can be transmitted from the transmitter of the transponder 14*b* through the window toward the vehicle 100*b* approaching the intersection on the lane Lb.

The underground block portion 42 is mounted with a case 45 housing the signal processing units (123*a*) of the radar units 12*a* and 12*b* and the amplifiers (143*a*) and the switching units (144*a*) of the transponders 14*a* and 14*b*.

Figure 7:
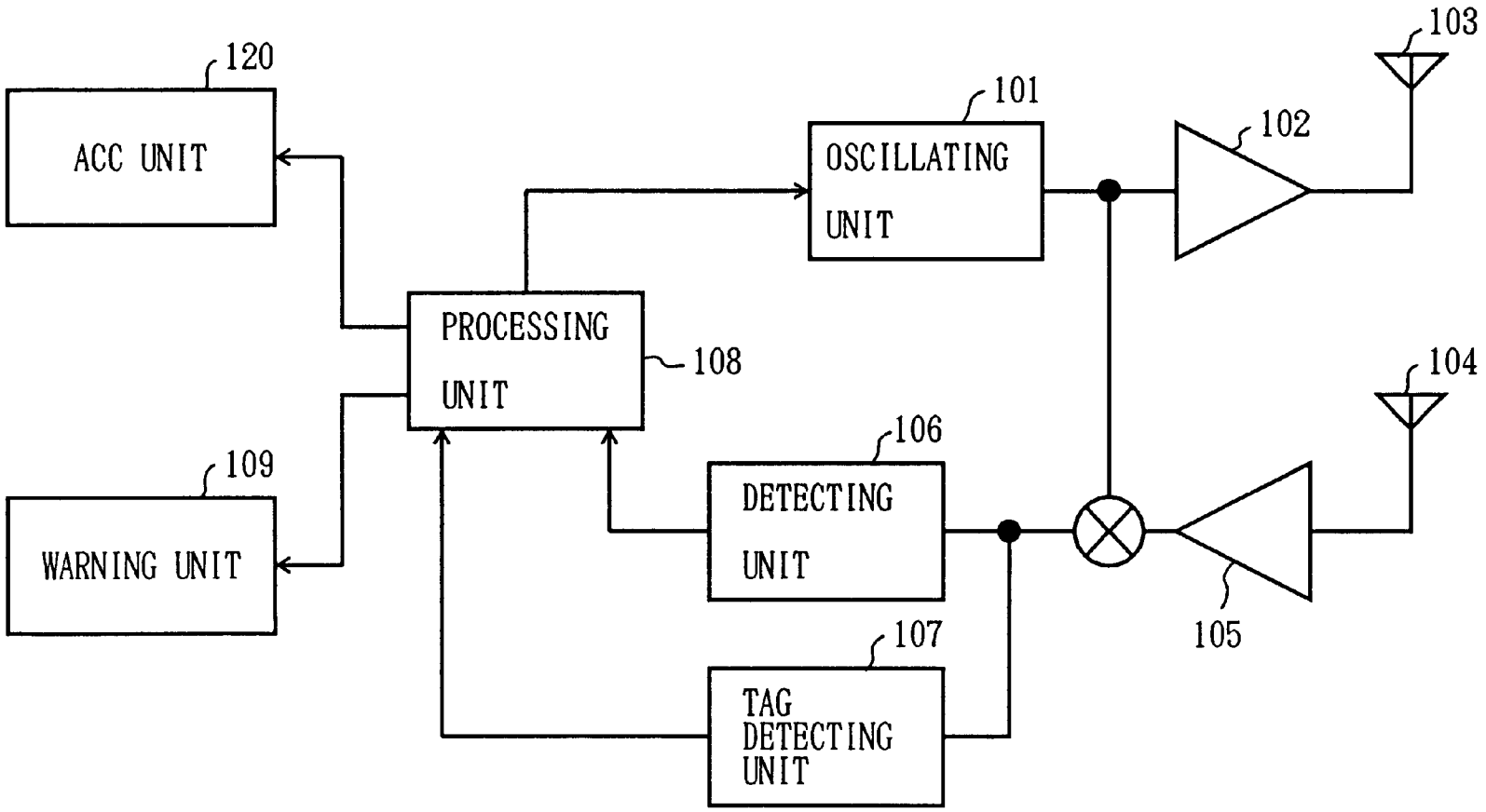
FIG. 7 is a block diagram illustrating a vehicle-side system used for the intersection warning system.

It is preferable that a vehicle passing through the intersection in which the road-side system as described above is installed has a system (a vehicle-side system) as shown in FIG. 7.

Referring to FIG. 7, the system has an oscillating unit 101, a transmitter 102, a transmission antenna 103, a receiving antenna 104, a receiver 105, a detecting unit 106, a tag detecting unit 107, a processing unit 108, a warning unit 109 and an ACC (Active Cruise Control) unit 120. A vehicle radar system formed of a transmitting system (the oscillating unit 101, the transmitter 102 and the transmission antenna 103) and a receiving system (the receiving antenna 104, the receiver 105 and the detecting unit 106) is, for example, an FMCW radar system.

The oscillating unit 101 generates signals having frequencies within a predetermined range. The signal generated by the oscillating unit 101 is transmitted, as the radar signal, by the transmitter 102 through the transmission antenna 103 toward the forward area of the vehicle. The detecting unit 106 compares a signal received by the receiver 105 through the receiving antenna 104 and the transmitted radar signal with each other and determines whether the received signal is a reflected signal obtained by reflecting the radar signal on a body in the forward area of the vehicle. In addition, the tag detecting unit 107 determines whether the tag signal is merged in the received signal.

The processing unit 108 controls the oscillating unit 101 and supplies control signals to the warning unit 109 and the ACC unit 120 based on determination results obtained by the detecting unit 106 and the tag detecting unit 107. When the detecting unit 106 determines that the received signal is the reflected signal of the radar signal and when the tag detecting unit determines that the tag signal is included in the received signal (the reflected signal), the processing unit 108 supplies a control signal to the warning unit 109 to cause the warning unit 109 to output a warning including intersection information based on the tag signal. In addition, when the detecting unit determines that the received signal is the reflected signal of the radar signal and when the tag detecting unit determines that the tag signal is not included in the received signal (the reflected signal or if the tag detecting unit is not preset), the processing unit 108 supplies to the ACC unit 120 a warning unit 109 information appropriate to the required response to (ACC or WARNING). Further, when the detecting unit 106 determines that the received signal is not the reflected signal, the processing unit 108 supplies the control signals to neither the warning unit 108 nor the ACC unit 120 (the warning is not issued and the active cruise control (ACC) is not carried out).

Figure 8:
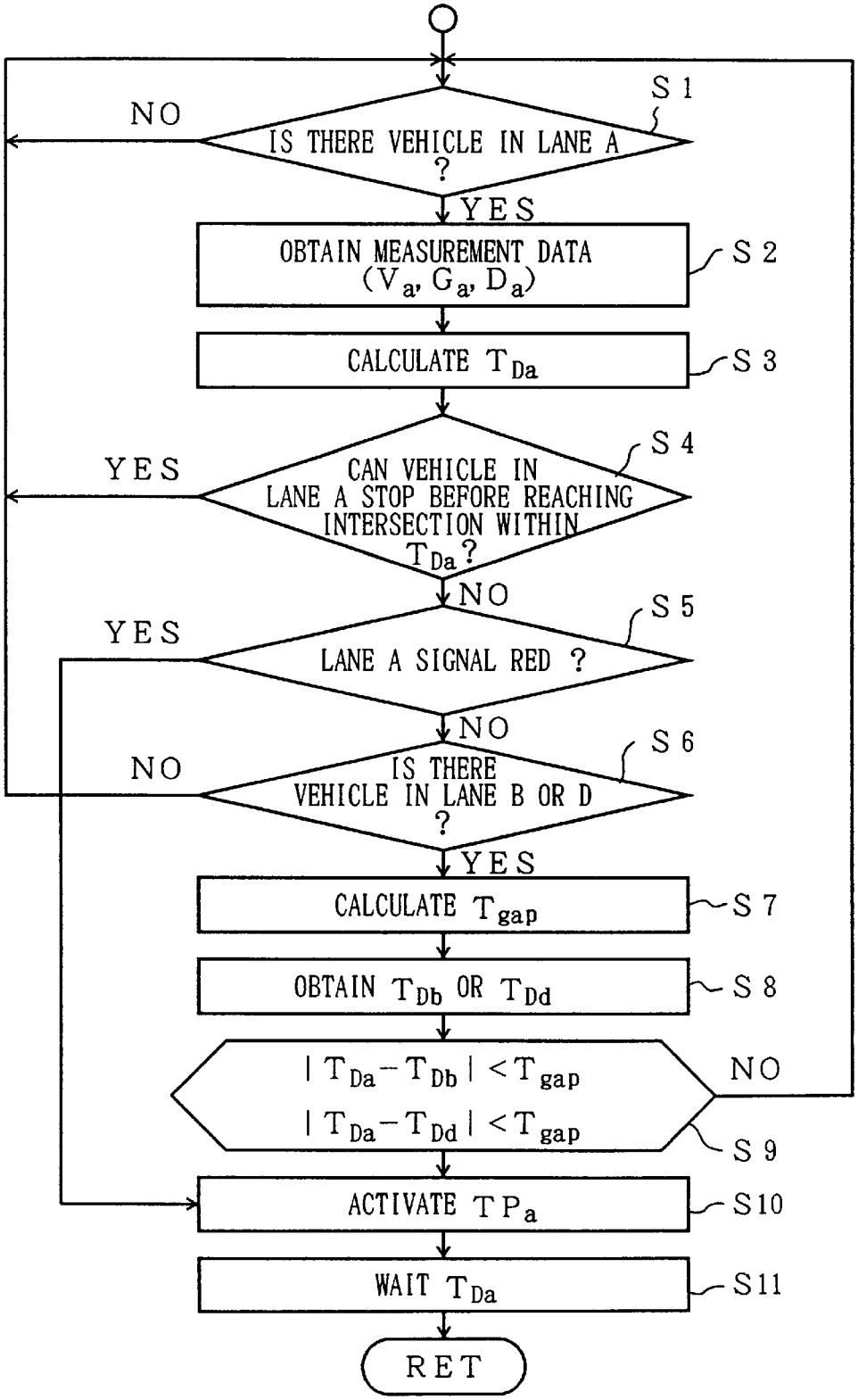
FIG. 8 is a flowchart illustrating a procedure of a process carried out by a controller of the road-side system.

The controller 10 mounted in the road-side device 200 carries out a process in accordance with a procedure as shown in FIG. 8. Although FIG. 8 shows the procedure of the process for watching the vehicle 100*a* running on the lane La, processes for watching the vehicles 100*b*, 100*c* and 100*d* running on the lanes Lb, Lc and Ld are carried out, in parallel, in the same procedure as the process for watching the vehicle 100*a*.

Referring to FIG. 8, the controller 10 always determines, based on signals supplied from the radar unit 12*a*, whether there is a vehicle approaching the intersection on the lane La (S1). The controller 10, in the same manner, determines, based on signals from the radar units 12*b*, 12*c* and 12*d*, whether there are vehicles approaching the intersection on the lanes Lb, Lc and Ld.

In this state, if it is determined that there is a vehicle 100*a* approaching the intersection on the lane La, measurement data, such as the speed Va and the acceleration rate Ga of the vehicle 100*a* and the distance Da between the vehicle and an entrance position to the intersection, supplied from the radar unit 12*a* are set (S2). Further, a time $T_{Da}$ required for the vehicle 100*a* to reach the intersection is calculated based on the measurement data (S3). The time $T_{Da}$ is calculated by solving the following equation.

$$Da=(½)\cdot Gb\cdot(T_{Da})^2+Vb\cdot T_{Da}$$

It is then determined whether the vehicle 100*a* can stop before reaching the intersection within the time $T_{Da}$ (S4). Assuming that the vehicle 100*a* is relatively rapidly braked so that the vehicle 100*a* is decelerated, for example, at the rate of 0.3 G, the above determination operation in step S4 is carried out. That is, it is determined whether the following inequality holds.

$$Da\geqq(-½)\cdot 0.3\ G\cdot(T_{Da})^2+Va\cdot T_{Da}$$

If it is determined that the vehicle 100*a* can stop before reaching the intersection within the time $T_{Da}$, that is, if it is determined the above inequality holds, the process returns to step S1, and steps S1, S2, S3 and S4 are then repeated.

On the other hand, if it is determined that the vehicle 100*a* cannot stop before reaching the intersection within the time $T_{Da}$, that is, if it is determined that the above inequality does not hold, the controller 10 further determines, based on switching signals for the traffic-signals 300*a*–300*d* in the traffic-signal controller 20, whether the traffic-signal 300*a* for the lane La is red (prohibition of passing) (S5). If it is determined that the traffic-signal 300*a* is not red (is green), the vehicle 100*a* approaching the intersection may pass through the intersection. Then, it is further determined whether other vehicles are approaching the intersection from the sides (S6). That is, as has been described above, it is determined whether there are vehicles approaching the intersection on the lanes Lb and Ld which intersect the lane La (steps corresponding to step S1). The controller 10 obtains the determination results.

If there is a vehicle 100*b* or 100*d* approaching the intersection on the lane Lb or Ld, the controller 10 calculates a reference time $T_{gap}$ (S7). The reference time $T_{gap}$ is obtained by solving the following equation.

$$L+C=(½)\cdot Ga\cdot(T_{Da})^2+VaO\cdot T_{gap}$$

In the above equation, L is a width of road passed at the intersection by the vehicle 100*a*, C is the length of the vehicle 100*a* and the VaO is a speed at which the vehicle 100*a* enters the intersection. That is, the time $T_{gap}$ is a time required for the vehicle 100*a* which enters the intersection to completely go out of the intersection.

After this, the controller 10 obtains a time $T_{Db}$ or $T_{Dd}$ which has been already calculated as a time needed by the vehicle 100*b* or 100*d* running on the lane Lb or Ld to reach the intersection (S8). It is then determined whether the difference between the time $T_{Da}$ and the time $T_{Db}$ or $T_{Dd}$ is less than the reference time $T_{gap}$ ($|T_{Da}-T_{Db}|<T_{gap}$ or $|T_{Da}-T_{Dd}|<T_{gap}$) (S9).

A case where the above difference is less than the reference time $T_{gap}$ ($|T_{Da}-T_{Db}|<T_{gap}$ or $|T_{Da}-T_{Dd}|<T_{gap}$) means that the vehicle 100*a* will not yet have gone out of the intersection when the vehicle 100*b* or 100*d* reaches the intersection from the side. Thus, when the above difference is less than the reference time $T_{gap}$, the warning should be issued, so the controller 10 causes the switching unit 144*a* of the transponder 14*a* (see FIG. 4) to be in the on-state (S10). After the time $T_{Da}$ which is estimated for the vehicle 100*a* to reach the intersection elapses, the process returns to the initial step.

Under a condition in which the switching unit 144*a* of the transponder 14*a* is in the on-state (the transponder 14*a* is activated), if the vehicle 100*a* approaching the intersection on the lane La has the vehicle-side system as shown in FIG. 7, the intersection warning system operates as follows.

The radar signal emitted from the transmitter 102 through the transmitting antenna 103 toward the forward area of the vehicle 100*a* is received by the receiver 141*a* of the transponder 14*a* installed in the intersection (see FIG. 5). The radar signal is then supplied through the switching unit 144*a* and the amplifier 143*a* to the transmitter 142*a*. At this time, the tag signal from the tag signal merger circuit 16 has been supplied to the amplifier 143*a*. As a result, the transmitter 142*a* returns the received radar signal merged with the tag signal as a virtual reflected signal toward the vehicle 100*a*. This virtual reflected signal is then received by the receiver 105 through the receiving antenna 104 in the vehicle 100*a*. The detecting unit 106 compares the received signal supplied from the receiver 105 and the radar signal to be emitted by the transmitter 102. The detecting unit 106 then determines based on the comparison result that the received signal is the reflected signal of the radar signal.

Figure 9:
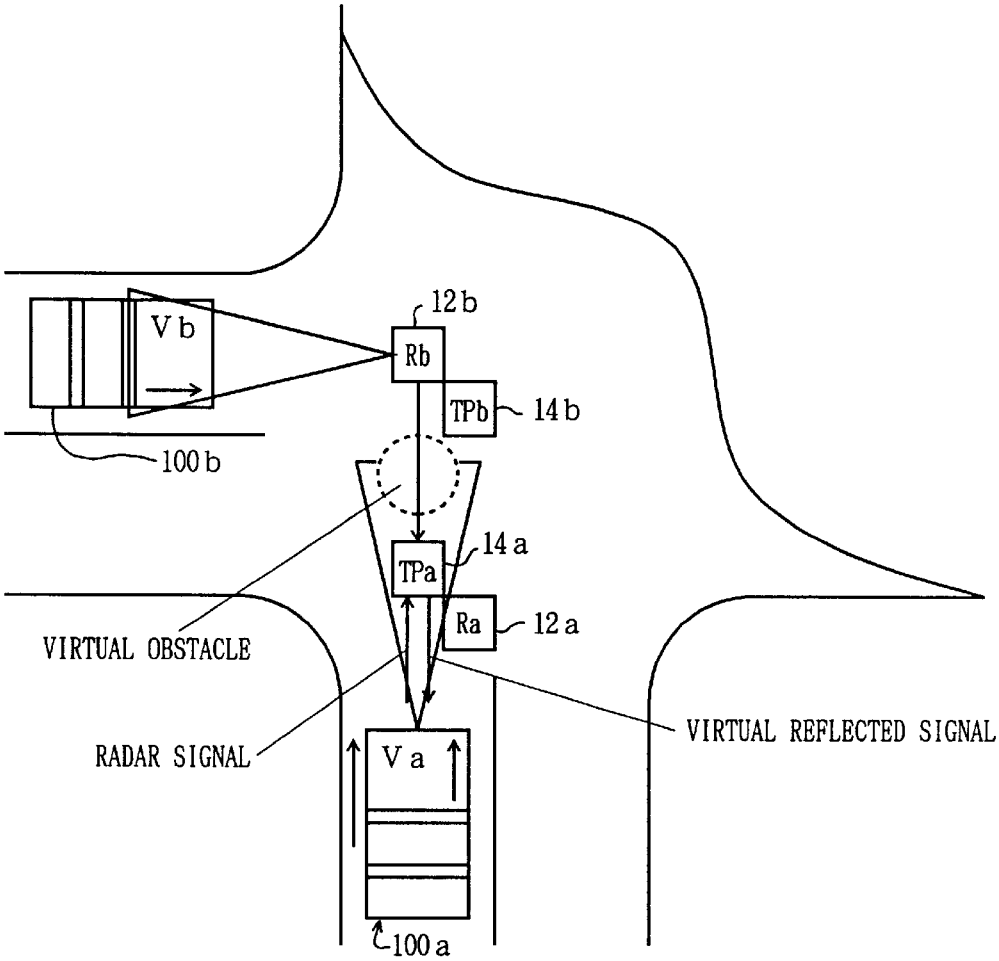
FIG. 9 is a diagram illustrating a state in which vehicles approaching the intersection on lanes that cross each other.

In this case, the vehicle-side system mounted in the vehicle 100*a* recognizes, based on the virtual reflected signal as described above, that there is a body in the forward area of the vehicle 100*a* as shown in FIG. 9. This body is a virtual obstacle recognized based on the virtual reflected signal generated by the transponder 14*a*.

Further, the tag detecting unit 107 determines that the signal received by the receiver 105 is merged with the tag signal. Based on the determination results obtained by the detecting unit 106 and the tag detecting unit 107, the processing unit 108 supplies the warning control signal to the warning unit 109. As a result, the warning unit 109 issues a warning (a warning sound, a warning display or vibration of the driver's seat) to attract a driver's attention.

Due to the warning, the driver of the vehicle 100*a* carefully views the circumstances of the intersection and can drive the vehicle while recognizing that a vehicle is approaching the intersection from the side.

In the process of the controller 10 mounted in the road-side device 200 shown in FIG. 1, when it is determined that the vehicle 100*a* cannot stop before the reaching the intersection within the time $T_{Da}$ (NO in step S4) and the traffic-signal 300*a* on the lane La is red (YES in step S5), the switching unit 144*a* of the transponder 14*a* is turned on whether or not there is a vehicle approaching the intersection from the side. As a result, if the vehicle 100*a* has the vehicle-side system as shown in FIG. 7, due to the same operations as in the above case, the warning is issued by the warning unit 109. Due to the warning, the driver becomes aware of the red sign of the traffic-signal 300*a* in the intersection and can carry out the braking operation to rapidly stop.

According to the intersection warning system as described above, the oscillating unit 101, the transmitter 102, the transmitting antenna 103, the receiving antenna 104, the receiver 105 and the detecting unit 106 can be shared with the ACC system and the obstacle avoidance system. As a result, the vehicle can be further intellectualized with minimal increment of the number of hardware parts and cost.

In addition, the oscillating unit 101, the transmitter 102, the transmitting antenna 103, the receiving antenna 104, the receiver 105, the detecting unit 106, the processing unit 108 and the warning unit 109 can be used for the obstacle detecting system for detecting obstacles in the forward area of the vehicle.

In the intersection warning system as described above, the radar units 12*a*–12*d* and the transponders 14*a*–14*d* are mounted in the mounting blocks 400*ab* and 400*cd* which are installed in the intersection as shown in FIGS. 5 and 6. The installation constitution of the radar units 12*a*–12*d* and the transponders 14*a*–14*d* is not limited to this. For example, the radar units 12*a*–12*d* and the transponders 14*a*–14*d* may be attached to a traffic-signal at otherwise suspended over the intersection.

In addition, the tag signal merger circuit 16 mounted in the road-side device 200 and the tag detecting unit 107 of the vehicle-side system are not necessarily needed in the intersection warning system. In such a system, when another vehicle approaching the intersection from the side is detected, for example, the ACC system or the obstacle detecting system is activated and the warning is issued.

The present invention is not limited to the aforementioned embodiments, and other variations and modifications may be made without departing from the scope of the claimed invention.

What is claimed is:

1. An intersection warning system comprising:

a vehicle-side system provided in a vehicle; and a road-side system, wherein said vehicle-side system comprises:

a transmitting unit emitting a radar signal to a forward area of said vehicle;

a receiving unit receiving a signal from the forward area of said vehicle;

a reflected signal detecting unit determining whether the signal received by said receiving unit is a reflected signal of the radar signal emitted by said transmitting unit; and warning means for issuing a warning when said reflected signal detecting unit determines that the received signal is the reflected signal of the radar signal, and wherein said road-side system comprises:

a signal return unit, provided for each of lanes intersecting each other at an intersection, receiving the radar signal from the vehicle approaching the intersection on each of the lanes and returning a virtual reflected signal toward the vehicle;

a vehicle watching unit watching the lanes intersecting each other at the intersection and detecting a vehicle approaching the intersection; and control means for activating said signal returning unit provided for at least one of the lanes when said vehicle watching unit detects vehicles approaching the intersection on the lanes intersecting each other.

2. The intersection warning system as claimed in claim 1, wherein said control means comprises:

running state detecting means for detecting a running state of each of vehicles approaching the intersection; and warning determination means for determining, based on the running state of each of the vehicles, whether a warning should be issued, wherein when said warning determination means determines that the warning should be issued, said signal return unit is activated.

3. The intersection warning system as claimed in claim 1, wherein said signal return unit comprises:

receiving means for receiving the radar signal from the vehicle;

transmitting means for returning the radar signal received by said receiving means as the virtual reflected signal toward the vehicle when being connected to said receiving means; and switching means for switching connection and disconnection between said receiving means and said transmitting means, wherein said control means controls said switching means so that said receiving means and transmitting means are connected and disconnected.

4. The intersection warning system as claimed in claim 1, wherein said road-side system further comprises:

information merger means for merging the virtual reflected signal from said signal return unit with predetermined information, wherein said vehicle-side system further comprises:

merger information determination means for determining whether the predetermined information is included in the signal received by said receiving unit, and wherein when said merger information determination means determines that the predetermined information is included in the received signal, said warning means issues the warning.

5. An intersection warning system comprising:

a vehicle-side system provided in a vehicle; and a road-side system, wherein said vehicle-side system comprises:

a transmitting unit emitting a radar signal to a forward area of said vehicle;

a receiving unit receiving a signal from the forward area of said vehicle;

a reflected signal detecting unit determining whether the signal received by said receiving unit is a reflected signal of the radar signal emitted by said transmitting unit; and warning means for issuing a warning when said reflected signal detecting unit determines that the received signal is the reflected signal of the radar signal, and wherein said road-side system comprises:

a signal return unit, provided for each of lanes intersecting each other in an intersection, receiving the radar signal from the vehicle approaching the intersection on each of the lanes and returning a virtual reflected signal toward the vehicle;

a vehicle watching unit watching the lanes intersecting each other at the intersection and detecting a running state a vehicle approaching the intersection on each of the lanes;

signal state detecting means for detecting a state of a traffic-signal provided for each of the lanes at the intersection, the traffic-signal indicating at least a first state for permitting vehicles to pass through the intersection and a second state for prohibiting vehicles from passing through the intersection;

warning determination means for determining, based on the running state of the vehicle detected by said vehicle watching means and the state of the traffic-signal detected by said signal state detecting means, whether a warning should be issued; and control means for activating said signal return unit when said warning determination means determines that the warning should be issued.

6. The intersection warning system as claimed in claim 5, wherein said signal return unit comprises:

receiving means for receiving the radar signal from the vehicle;

transmitting means for returning the radar signal received by said receiving means as the virtual reflected signal toward the vehicle when being connected to said receiving means; and switching means for switching connection and disconnection between said receiving means and said transmitting means, wherein said control means controls said switching means so that said receiving means and transmitting means are connected and disconnected.

7. The intersection warning system as claimed in claim 5, wherein said road-side system further comprises:

information merger means for merging the virtual reflected signal from said signal return unit with predetermined information, wherein said vehicle-side system further comprises:

merger information determination means for determining whether the predetermined information is included in the signal received by said receiving unit, and wherein when said merger information determination means determines that the predetermined information is included in the received signal, said warning means issues the warning.

8. A vehicle-side intersection warning system comprising:

a transmitting unit emitting a radar signal to a forward area of said vehicle;

a receiving unit receiving a signal from the forward area of said vehicle;

a reflected signal detecting means determining whether the signal received by said receiving unit is a reflected signal of the radar signal emitted by said transmitting unit;

a merger information determination unit determining whether the received signal includes predetermined information; and warning means for issuing a warning when said reflected signal detecting means determines that the received signal is the reflected signal of the radar signal and said merger information determination unit determines that the received signal includes the predetermined information.

* * * * *